United States Patent [19]

Ballew

[11] 4,043,602

[45] Aug. 23, 1977

[54] METHOD AND APPARATUS FOR CONSTRUCTING A MOP

[75] Inventor: Audrey H. Ballew, Sweetwater, Tex.

[73] Assignee: Dallas County Association for the Blind, Dallas, Tex.

[21] Appl. No.: 680,964

[22] Filed: Apr. 27, 1976

[51] Int. Cl.[2] ..... A46D 3/04

[52] U.S. Cl. ..... 300/16; 300/21; 15/229 R

[58] Field of Search ..... 300/16, 21

[56] References Cited

U.S. PATENT DOCUMENTS

| | | | |
|---|---|---|---|
| 2,122,318 | 6/1938 | Jobst | 300/21 |
| 2,303,470 | 12/1942 | Jobst | 300/21 |
| 2,964,353 | 12/1960 | Carpenter et al. | 300/16 |
| 3,430,281 | 3/1969 | Baumgartner | 300/21 |

*Primary Examiner*—Granville Y. Custer, Jr.
*Attorney, Agent, or Firm*—Howard E. Moore; Gerald G. Crutsinger

[57] ABSTRACT

A method and apparatus for constructing a mop head comprising a ram adapted to be urged downwardly having a ram head thereon to insert a rigid mop fiber securing wire into a preformed mop head. As the ram moves downwardly, the mop head is inserted in a resiliently mounted mop head support apparatus to align the mop head with the ram. Mop fibers are placed over the mop head and metal fingers are positioned over the ends of the mop head. The ram head engages guide members to align the securing wire with the mop head and the ram is urged downwardly, causing the ends of the wire to engage the metal fingers such that the wire is moved past the metal fingers and under shoulders formed in the ends of the mop head and securely positioned thereon and retain the mop fibers therein. The fibers frictionally engage the sides of the mop head and are retained therein by the wire.

15 Claims, 8 Drawing Figures

METHOD AND APPARATUS FOR CONSTRUCTING A MOP

BACKGROUND

Heretofore mops have usually been constructed by winding wire about the top of the fibers onto the handle or constructed by a gluing process which is tedious and time consuming. The mop is constructed by winding a wire about the fibers requiring complicated machinery to wind the wire while holding the fibers. The gluing process requires a time period in which the glue must dry and a plastic or glue injecting machine to apply same.

These machines also require a high degree of training for operation.

SUMMARY

I have devised a method and apparatus for securing mop fibers to a preformed mop head by pressing a mop fiber retaining wire on top of and midway of the ends of the mop fibers into the mop head until the ends of said wire spring under and engage shoulders formed in the mop head, preventing the removal of the wire or mop fibers.

The press for applying the wires comprises a ram adapted to be urged downwardly, having a ram head formed thereon with spring biased guide members thereon. The steel wire is placed between the guide members and along a groove formed in the ram head. The head is urged downwardly, engaging a resiliently mounted mop head support block such that the guide means on the head engage guide members on the mop head support block. The support block has a cavity formed therein which receives and supports the mop head thereby preventing breaking.

Guide fingers are pivotally mounted on the mop head support block and are adapted to be positioned over the ends of the mop head to form a guide for the ends of the retainer wire to move past the rim of the mop head without damaging same.

As the ram head moves downwardly and engages the mop head support block, the ram head forces the ends of the wire past the fingers to engage the shoulders formed inside the rim of the mop head.

The resiliently mounted mop head support block will also move downwardly to absorb the shock of the ram moving against the mop head. The mop fibers are then held in place by frictional engagement with the sides of the mop head and by the retainer wire engaged under the shoulders against the fibers forming U-shaped fibers firmly held by the mop head. The head is then removed from the support block and the process repeated.

A primary object of the invention is to provide a method and apparatus for constructing a simple mop which firmly secures the fibers therein and which requires a minimal amount of training to operate same and provides a mop head of durability and attractive appearance.

A further object of the invention is to provide a mop head which is simple in construction requiring a minimal amount of labor and materials to construct.

A further object of the invention is to provide apparatus and method of constructing a mop head which is readily adapted to mass production, thereby minimizing the cost of labor and materials required to construct the mop.

Other and further objects of the invention will become apparent upon a consideration of the description hereinafter following and the drawings annexed hereto.

DESCRIPTION OF THE DRAWINGS

Drawings of a preferred embodiment of the invention are annexed hereto so that the invention may be more clearly understood, in which.

Numeral references are employed to designate parts shown in the drawings and like numerals designate like parts throughout the various figures of the drawings.

DESCRIPTION OF A PREFERRED EMBODIMENT

Figure 1:
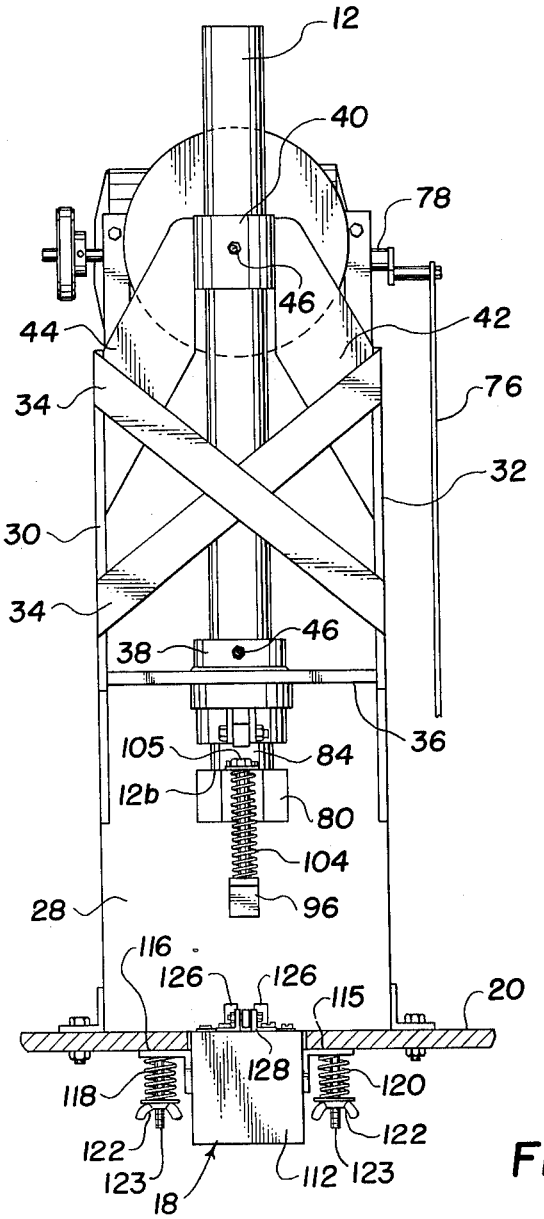
FIG. 1 is a front elevational view of the ram press with parts broken away to more clearly illustrate the details on construction.
Figure 2:
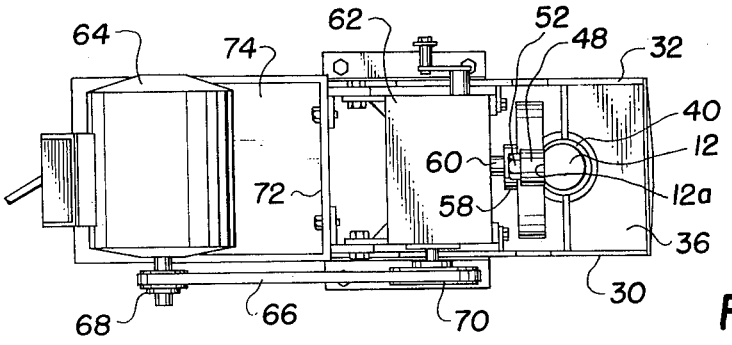
FIG. 2 is a plan view thereof.
Figure 3:
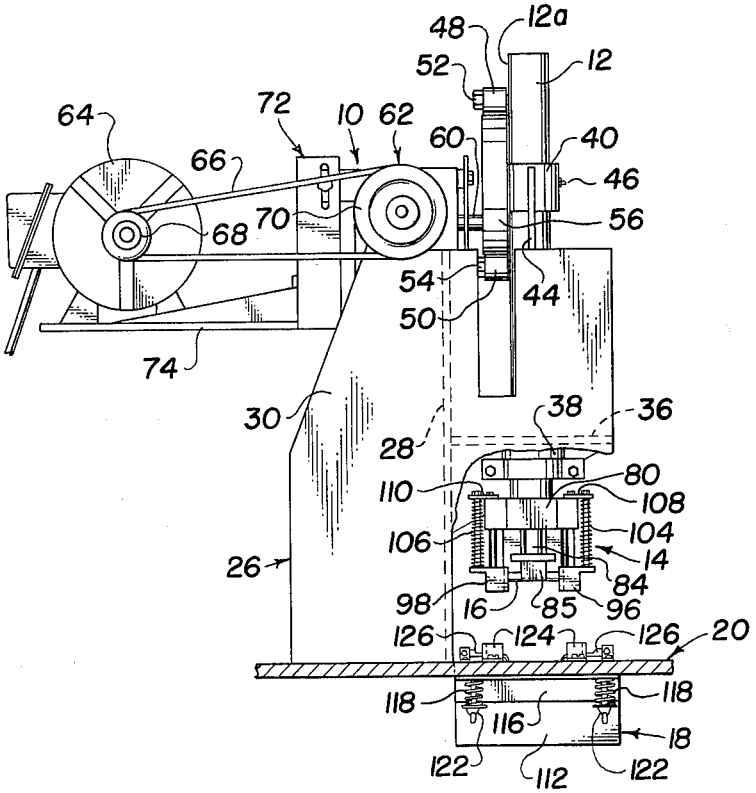
FIG. 3 is a left side elevational view thereof with parts broken away to more clearly illustrate the details of construction.

Referring to FIGS. 1-3 of the drawings, the numeral 10 generally designates an actuating means which is adapted to urge ram 12 downwardly. Ram 12 has a ram head 14 secured thereto adapted to hold a spring-like wire 16. A mop head holder means 18 is resiliently mounted to a support table 20 and aligned with the ram head 14. The mop head holder is adapted to hold a molded plastic mop head 22 such that the ram head 14 urges the wire 16 and fibers 24 into the mop head 22 as will be more fully explained hereinafter.

Figure 7:
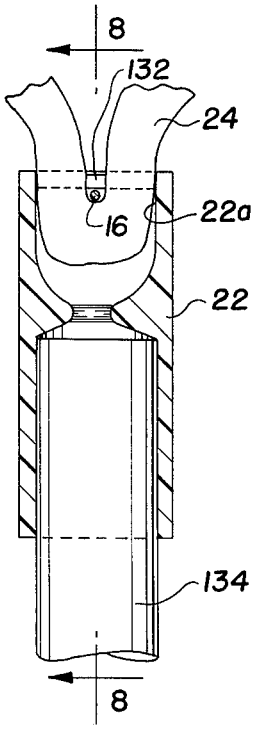
FIG. 7 is a cross-sectional view of the completed mop head with fibers mounted therein.
Figure 8:
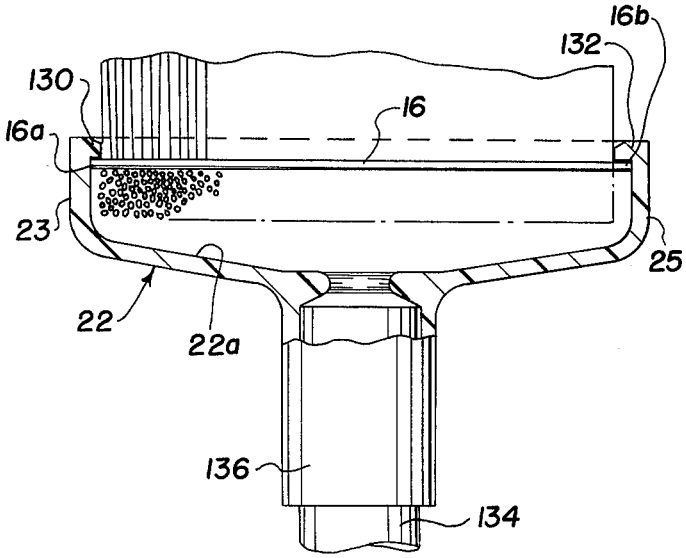
FIG. 8 is a cross-sectional view taken along line 8-8 of FIG. 7.

As best illustrated in FIGS. 7 and 8, mop head 22 comprises an elongated body having a cavity **22*a* formed therein. A handle attaching sleeve 136 extends outwardly from the body. Shoulders 130 and 132 are formed on each end 23 and 25 of mop head 22, respectively, the shoulders being transverse to the longitudinal axis of the elongated body 22. Ends 16a and 16b of wire 16 are adapted to be positioned under shoulders 130 and 132 after the wire has been deformed. The wire 16 is inserted in the cavity 22a and the ends spring out under shoulders 130 and 132. The wire 16, after being positioned therein retains fibers 24 in cavity 22*a* by frictional pressure between the wire 16 and sides of cavity 22*a* and wire 16** prevents the fibers from being expelled from the cavity.

Referring to FIGS. 1-3 of the drawings, the actuating means 10 generally comprises a general frame 26 comprising an upwardly extending member 28 rigidly secured to spaced vertical panels 30 and 32 which are secured to table 20. Cross braces 34 are rigidly secured to the front of panels 30 and 32. A horizontally extending plate 36 having a passage centrally formed therein is secured to side panels 30 and 32 and upwardly extending member 28.

Ram support means comprises a first collar 38 which is welded or otherwise secured in the central passage formed in plate 36, and a second collar 40 welded or otherwise secured to angular support members 42 and 44 which rigidly secured to side panels 30 and 32. Ram 12 is slideably disposed through collars 38 and 40 which have grease fittings 46 for lubrication of the ram 12 to minimize friction.

Ram 12, as best illustrated in FIGS. 2 and 3, has roller bearings 48 and 50 rotatably secured to the rear edge 12a of ram 12 by bolts 52 and 54. Roller bearings 48 and 50 are spaced apart and adapted to engage fly wheel 56.

Fly wheel 56 is eccentrically secured to a drive shaft 60 by coupling 58 such that rotation of the fly wheel 56 moves ram 12 downwardly and upwardly in support collars 38 and 40.

Drive shaft 60 is driven by transmission means such as clutch energized transmission 62 having drive means such as an electric motor 64. V-belt 66 rotatably connects pulleys 68 and 70 to drive transmission 62. Motor 64 and transmission 62 are rigidly secured to support members 72 and 74 which are rigidly secured to side panels 30 and 32.

Clutch engagement means such as rod 76 moves the transmission actuating arm 78 to engage the clutch of transmission 62 for one revolution of fly wheel 56 at which time the transmission automatically disengages. It should be readily apparent that other means of urging ram 12 upwardly and downwardly such as hydraulic and pneumatic cylinders may be used.

Figure 4:
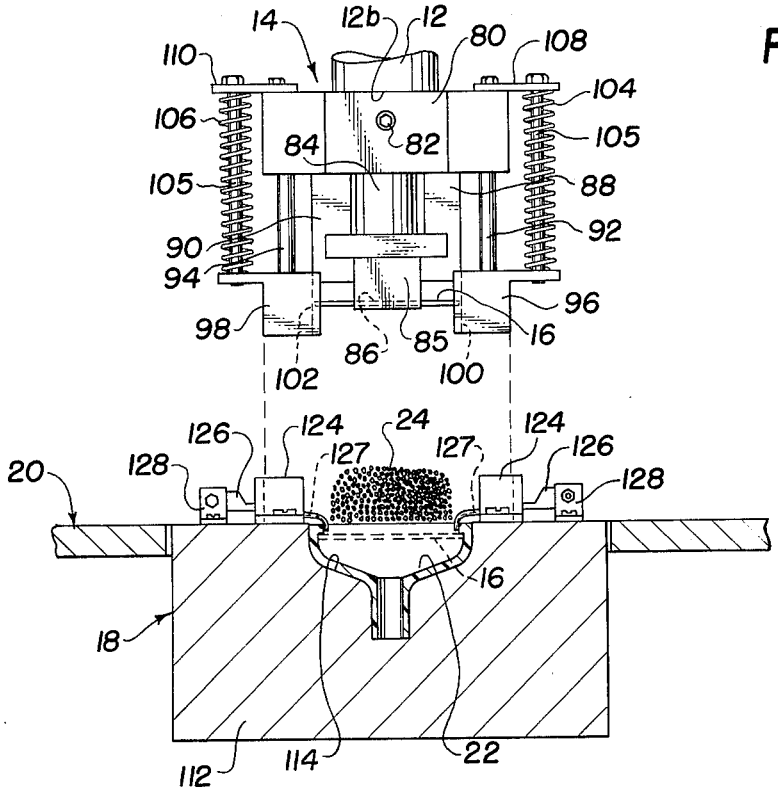
FIG. 4. is an enlarged side elevational view of the ram head and mop head support means with parts broken away to more clearly illustrate the details of construction.

As best illustrated in FIGS. 1, 3, and 4, ram head 14 comprises a coupling block 80 having a set screw 82 to rigidly secure block 80 to stud 84 formed on the end of ram 12. Block 80 engages shoulder 12b formed on the lower end of ram 12. A ram blade 85, having a groove 86 formed centrally of the lower edge thereof, is secured to support block 80 by reinforcing members 88 and 90. Guide blocks 96 and 98 having opposed grooves 100 and 102 therein are slideably disposed on reinforcing members 88 and 90 and guide rods 92 and 94 secured to block 80. Guide blocks 96 and 98 are urged downwardly by springs 104 and 106 slideably disposed on bolts 105 which are secured to blocks 96 and 98 and slideably disposed through passages formed in ears 108 and 110 bolted or otherwise secured to the upper edge of support block 80.

The ends of flexible wire 16 are positioned in opposed grooves 100 and 102 of guide blocks 96 and 98 and engages groove 86 formed in blade 85 and is frictionally held therein.

Mop head support means 18 comprises a rectangular shaped block 112 having a cavity 114 formed therein in the general shape of the mop head 22 to provide surface support for the exterior of the mop head 22.

Block 112 has angles 115 and 116 rigidly secured thereto by welding or the like. Springs 118 and 120 positioned between the lower edges of angles 116 and 115 and wing nuts 122 and screws 123 urge angles 115 and 116 upwardly and therefore urge block 112 upwardly to be aligned with the upper surface of support table 20.

Figure 5:
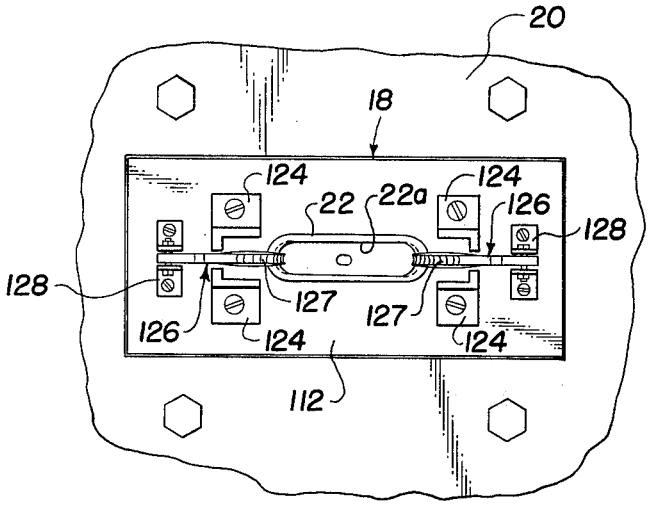
FIG. 5 is a plan view of the mop head support means.

Guide members 124 are bolted or otherwise secured to the upper surface of block 112, as best illustrated in FIGS. 4 and 5. Guide members 124 are aligned with and adapted to engage downwardly descending guide members 96 and 98 so as to align blade 84 with the longitudinal axis of the mop head 22.

Means to guide the wire 16 into the mop head comprises metal fingers 126 having a concave groove 127 formed in the upper surface thereof along the longitudinal axis of the finger. Fingers 126 are pivotally secured to support means 128 by screws or the like. The ends **16*a* and 16*b* of wire 16 engage the curved surfaces of fingers 126 and are guided into the mop head 22 so that the wire 16 does not damage the soft plastic material of mop head 22**.

Figure 6:
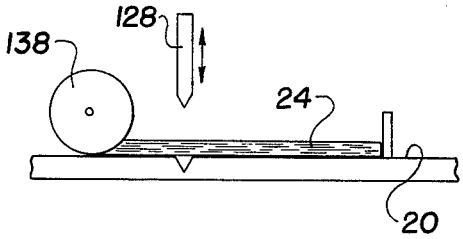
FIG. 6 is a diagrammatic view of means to cut mop fibers in a continuous production process.

As diagrammatically illustrated in FIG. 6 reciprocating cutting blade or knife 128 is adapted to cut mop fibers 24 into predetermined lengths. The mop fibers 24 are then positioned over block 112 such that the longitudinal axis of the mop fibers 24 is transverse to the longitudinal axis of the mop head 22. The ram head 14 is adapted to urge wire 15 downwardly until ends **16*a* and 16*b* engage fingers 126. The wire is then flexibly deformed to move the ends 16a and 16*b* thereof along the grooves on the surfaces of fingers to cause the ends to move into the cavity 22*a* formed in mop head 22**.

Shoulders 130 and 132 are adapted to engage ends 16a and 16b of wire 16 after the ends are moved below the shoulders and springs outwardly below the shoulders into cavity 22a of mop head 22. It should be readily apparent that wire 16 should be relatively stiff yet have some flexible characteristics so that it will bend slightly going into the cavity yet will return to its original straight length, thereby engaging shoulders 130 and 132 formed in mop head 22. As best illustrated in FIGS. 7 and 8, fibers 24 are engaged between wire 16 and the sides of cavity **22*a* of mop head 22** and are positively and frictionally held therein.

Mop head 22 is preferably constucted of plastic such as bakelite or polyvinyl chloride to provide a lightweight mop head but could be made of metal or other suitable material. The mop head fibers 24 may be of any suitable type such as cotton or synthetic type fibers now commonly used.

Wire 16 should be relatively rigid and have spring-like qualities such as spring steel wire. A handle 134 may be inserted and secured into the bore of handle attaching sleeve 136.

Operation of the hereinbefore described device is as follows:

Suitable lengths of fibers 24 may be automatically cut from a reel 138 by reciprocating blade 128 or may be obtained in predetermined lengths for insertion by hand. The fibers are placed over resiliently mounted mop head supporting means 18 such that the longitudinal axis of the fibers 24 is transverse to the longitudinal axis of the mop head 22. A wire 16 is inserted in grooves 100 and 102 against groove 86 of blade 85 and frictionally held therein. Rod 76 is then moved to engage transmission 62. Transmission 62 rotates drive shaft 60, turning eccentrically mounted fly wheel 56 to engage rollers 48 and 50. Ram 12 is urged downwardly by eccentric motion of fly wheel 56 until guide members 86 and 98 engage guide members 124 mounted on block 112. Movement of fly wheel 56 continues to move blade 85 downwardly until ends **16*a* and 16*b* of wire 16 slide out of grooves 100 and 102 and engage the concave upper sides of fingers 126. Wire 16 bends slightly to shorten the distance between ends 16*a* and 16*b* thus allowing the ends 16*a* and 16*b* of wire 16 move into cavity 22a of mop head 22. As ends 16*a* and 16*b* pass shoulders 130 and 132 wire 16 straigtens thus moving ends 16*a* and 16*b* under the shoulders to retain the wire in the cavity 22. Blade 85 is withdrawn by further rotation of eccentrically mounted fly wheel 56. The fibers 24 are then held by the wire 16 and friction in mop head 22**.

From the foregoing it should be readily apparent that a mop head comprising three constructural parts, to-wit; a molded mop head, mop fibers and a wire to retain said mop fibers in said mop head may be easily constructed.

From the foregoing it should be readily apparent that the embodiment of the hereinbefore described accomplishes the objects of the invention hereinbefore discussed.

It should be appreciated that other and further embodiments of the invention may be devised without departing from the basic concept thereof.

Having hereinbefore described my invention, I claim:

1. Apparatus for assembling a mop head comprising: support means arranged to support a mop head having cavity formed therein, said cavity having opposed shoulders in the outer end thereof, ram; support means arranged to support the ram, means to slideably support said ram; ram; a ram head adapted to disengageably hold a spring wire; actuating means to urge said ram downwardly urging said spring wire into the cavity of the mop head such that the ends of said wire are engaged under the shoulders formed in the cavity to retain the wire therein.

2. The combination called for in claim 1 with the addition of: finger guide means secured on opposed sides of said cavity in said mop head and arranged to be positioned over opposed shoulders in said cavity in said mop head and adapted to guide the ends of the wire into said cavity of the mop head to prevent damage to the shoulders of the mop head.

3. The combination called for in claim 1 with the addition of: guide means carried by the ram arranged to resiliently engage the support means to align the ends of the spring-like member with the cavity in the mop head.

4. The combination called for in claim 1 with the addition of: means on the support means to guide the ends of the wire into the cavity.

5. The combination called for in claim 1 with the addition of: guide means secured to said ram on opposed sides of said ram head; and guide members secured on opposed sides of said cavity on said support means, said guide means being adapted to be aligned with said guide members on opposed sides of said cavity to align the ram head with the mop head disposed in the cavity on said support means.

6. The combination called for in claim 1 wherein the support means comprises a holder having cavity formed therein to support to mop head; a table; and means resiliently securing said holder to said table to allow vertical movement of said holder upon engagement of the ram head with the mop head.

7. In a device for making a mop; a frame; a ram slideably carried by the frame; a support member carried by the frame arranged to support a mop head having a cavity therein with opposed shoulders in the cavity; a ram head carried by the ram; means on the ram head to suport a flexible retainer member; and means to move the ram head toward the mop head to force the retainer member into the cavity until the ends thereof engage the shoulders.

8. The combination call for in claim 7 with the addition of: guide means carried by the ram to guide the retainer member into the cavity.

9. The combination called for in claim 8 wherein the guide means comprises: guide blocks slideably mounted on each side of the ram; opposed slots in the blocks arranged to receive ends of the retainer; and means to resiliently urge the blocks toward the support.

10. The combination called for in claim 9 with the addition of: guide members carried by the support member arranged to guide the ends of the retainer member into the cavity.

11. The combination called for in claim 10 wherein the guide members carried by the support for guiding the ends of the retainer members into the cavity comprises: opposed fingers extending into the cavity having concave guide surfaces therein arranged to slideably engage the ends of the retainer member.

12. The combination called for in claim 7 with the addition of: a table secured to said frame; means to resiliently mount said support member to said table to allow vertical member relative to said table.

13. The combination called for in claim 12 wherein the means to resiliently mount the support member comprises: a plate attached to the frame; suspension rods attached to the plate; brackets attached to the support slideably disposed about the rods; and springs between the rods and the brackets arranged to urge the brackets toward the plate.

14. A method of making a mop comprising the steps of: supporting a mop head having an upwardly facing cavity therein with opposed shoulders in the cavity; depositing a length of mop fibers over the cavity; positioning a flexible wire-like member of the fibers intermediate the ends thereof; and forcing the wire-like member into the cavity to cause it to bend and enter the cavity until the ends pass and relax under the shoulders to retain the fibers in the cavity.

15. A method of assembling a mop comprising the steps of: positioning an elongated mop head having a cavity formed therein with shoulders formed interiorally of the cavity in a support means; positioning mop fibers over the cavity such that the longitudinal axis of the fibers is transverse to the longitudinal axis of the elongated mop head; positioning a rigid spring-like retainer member over the mop fibers intermediate the ends thereof; and pressing the rigid retainer member into the cavity of the mop head moving the fibers therein until the ends of the springlike wire are engaged under the shoulders in the cavity to retain the mop fibers therein.

* * * * *

UNITED STATES PATENT AND TRADEMARK OFFICE

CERTIFICATE OF CORRECTION

PATENT NO. : 4,043,602

DATED : August 23, 1977

INVENTOR(S) : Audrey H. Ballew

It is certified that error appears in the above-identified patent and that said Letters Patent are hereby corrected as shown below:

In Column 5, line 19, delete "ram;" second occurence.

In Column 6, line 39, change "of" to -- over --.

In Column 6, line 54, change "springlike wire" to -- spring-like retainer member --.

Signed and Sealed this

*Thirteenth* Day of *December 1977*

[SEAL]

*Attest:*

RUTH C. MASON
*Attesting Officer*

LUTRELLE F. PARKER
*Acting Commissioner of Patents and Trademarks*